US005667334A

United States Patent [19]

Boyce

[11] Patent Number: 5,667,334

[45] Date of Patent: Sep. 16, 1997

[54] BASE FOR ROADWAY MARKER

[75] Inventor: Thomas P. Boyce, Palos Park, Ill.

[73] Assignee: Stimsonite Corporation, Niles, Ill.

[21] Appl. No.: 487,250

[22] Filed: Jun. 13, 1995

[51] Int. Cl.[6] ..... E01F 9/06

[52] U.S. Cl. ..... 404/9; 404/15

[58] Field of Search ..... 404/9, 12, 13, 404/14, 15, 16

[56] References Cited

U.S. PATENT DOCUMENTS

| | | | |
|---|---|---|---|
| 2,666,373 | 1/1954 | Mattson | 404/16 |
| 3,971,623 | 7/1976 | Hedgewick et al. | 404/16 X |
| 3,975,108 | 8/1976 | Suhr et al. | 404/16 |
| 3,980,410 | 9/1976 | Suhr et al. | 404/16 |
| 5,078,538 | 1/1992 | Montalbano | 404/15 X |
| 5,449,244 | 9/1995 | Sandino | 404/14 |

*Primary Examiner*—James Lisehora
*Attorney, Agent, or Firm*—Jones, Day, Reavis & Pogue

[57] ABSTRACT

A roadway marker comprises shell molded of suitable plastic and having an internal honeycomb configuration. A base plate extends over the lower surface of the shell covering the honeycomb arrangement and defining a plurality of chambers internal to the shell. The plate is provided with a plurality of apertures, each opening to a chamber. When the marker is installed, adhesive material flows through the apertures and into the chambers. Before the adhesive sets, it forms mushroomed-shaped configurations over the top inside surface of the plate. The mushroomed configurations create a strong mechanical bond between the plate and the associated roadway surface. The large lower surface area of the plate also enhances bonding of the marker to the roadway.

8 Claims, 2 Drawing Sheets

BASE FOR ROADWAY MARKER

BACKGROUND OF THE INVENTION

1. Field of the Invention

The present invention relates generally to an improved base for a roadway marker and more particularly to a marker base having improved pavement adherence capabilities when used with conventional adhesives.

2. Description of the Prior Art

Roadway markers have long been used to designate lanes of traffic and roadway centerlines. Early forms of roadway markers were constructed of a solid piece of ceramic material having a high gloss. Bumped protrusions were formed on the bottom surfaces of these markers to increase surface area for cooperation with a suitable adhesive material.

In more recent times, roadway markers evolved to the use of thermoplastics to form marker shells. For purposes of manufacturing economies, these markers are not formed into a solid structures like the early ceramic markers. Rather, they typically have a relatively thin wall with a series of internal ribs defining a plurality of chambers, much like in a waffle or honeycomb configuration. An example of such a marker is disclosed in U.S. Pat. No. D-267,933. In order to mold these markers, the ribs or chamber walls are downwardly tapered to a narrow dimension at the roadway surface. This is necessary to provide sufficient draft angle for removal of the marker from the mold. These markers are installed by depositing a suitable adhesive such as bitumen or epoxy on the roadway surface and pressing the marker downwardly into the adhesive.

It has been found that a disadvantage of the foregoing markers is that when the marker is pressed into the adhesive it exhibits a "cookie cutter" effect. Essentially, the narrow bottom surfaces of the chamber walls squeeze the adhesive upwardly into the chambers leaving little adhesive between the bottom marker surfaces and the roadway to anchor the marker firmly.

In order to improve the adherence capabilities of markers, a marker is known wherein the ribs or internal chamber walls are initially formed with the aforementioned tapering configuration. Then, in a separate manufacturing step, the bottom surfaces of the walls are thermally deformed to have a mushroom-like cross-section. This deformation essentially increases the bottom area of the walls and reduces the cookie cutter effect of the marker. The mushrooming of the walls also allows adhesive to flow into the chambers and over the tops of mushroom surfaces thereby providing an enhanced mechanical bond between the marker and the adhesive. An example of such a marker is disclosed in U.S. Pat. No. 5,078,538 issued Jan. 7, 1992 and assigned to the common assignee herein.

While markers as just described improve over earlier constructions, they are still not without disadvantages. Specifically, it has been found that markers having internal chambers sealed at their bottoms with adhesive experience pressure differentials between the ambient air pressure acting on the exposed shell of the marker and the air pressure internal to the chambers. Air pressure within the marker chambers increases notably, for example, if the marker is installed cold and then later is heated by the elevated ambient temperatures. This effect of differential pressure reduces the hold-down force on the marker. Another problem experienced by conventional markers is that a preferred adhesive material for installing markers is bitumen. Bitumen can be readily heated to a fluid state and poured onto the pavement in puddles at locations where markers are desired. The markers may then be pressed into the puddles and the bitumen may be allowed to cool. The bitumen hardens quickly as compared to alternative adhesives such as epoxy. A disadvantage of bitumen, however, is that it dramatically loses adhesive bonding strength with temperature. Thus, even with improved markers of the type disclosed in the aforementioned U.S. Pat. No. 5,078,538, the surface area of the typical marker bottom is still not sufficient to create a strong enough bond between the marker and bituminous adhesive, particularly at elevated temperatures.

Accordingly, it is desirable to provide an improved marker having a honeycomb interior for strength, but which does not exhibit a cookie cutter effect. It is further desirable to provide such a marker which is resistant to dislodging under the effects of air pressure differentials between ambient pressure and internal marker pressure. Still further, it is desirable to provide such a marker with a base having a relatively large surface area for enhanced mechanical bonding with preferred adhesive materials such as bitumen.

SUMMARY OF THE INVENTION

The present invention improves over the prior art by providing a roadway marker comprising a shell molded of suitable plastic and having an internal honeycomb configuration. A base plate extends over the lower surface of the shell covering the honeycomb arrangement and defining a plurality of chambers internal to the shell. The plate is provided with a plurality of apertures, each opening to a chamber. When the marker is installed, adhesive material flows through the apertures and into the chambers. Before the adhesive sets, it forms mushroomed-shaped configurations over the top inside surface of the plate. The mushroomed configurations create a strong mechanical bond between the plate and the associated roadway surface. The large lower surface area of the plate also enhances bonding of the marker to the roadway.

BRIEF DESCRIPTION OF THE DRAWINGS

The foregoing and other novel features and advantages of the invention will be understood by a reading of the following detailed description taken in conjunction with the accompanying drawings wherein.

DETAILED DESCRIPTION OF THE PREFERRED EMBODIMENT

Figure 1:
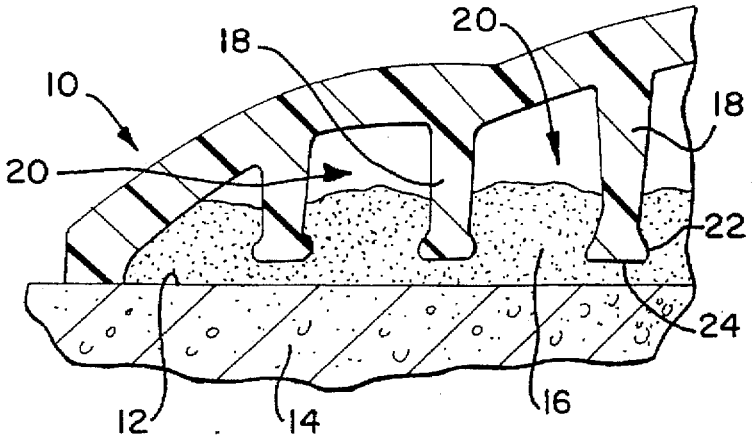
FIG. 1 (PRIOR ART)
FIG. 1 is a cross-sectional view of a roadway marker shell of known prior art construction.

Referring now to the drawings, and initially to FIG. 1, a roadway marker shell constructed in accordance with the prior art is designated generally by the reference numeral 10. The shell 10 is shown as being installed on a surface 12 of a roadway pavement 14 with suitable adhesive 16. Internal to the shell 10 are a series of strengthening ribs 18 arranged in a honeycomb configuration and defining chambers 20. In this example of a prior art marker, the ribs 18 have been thermally deformed at their lower surfaces to have a mushroomed cross-section 22. By this configuration, adhesive flows around and over the mushroomed surfaces 22 of the ribs 18 and thereby creates a mechanical bond between the roadway surface 12 and shell 10. However, it can be appreciated from FIG. 1 that differential air pressure between ambient air pressure and the pressure within the chambers 20 can reduce the hold-down force on the marker shell 10 as increased pressure within the chambers 20 acts on upper surfaces 24 of the cured adhesive. Further, the bottoms 26 of the mushroomed surfaces 22 have relatively small surface areas. Therefore, the mechanical bond with the roadway surface 12 is somewhat limited.

Figure 2:
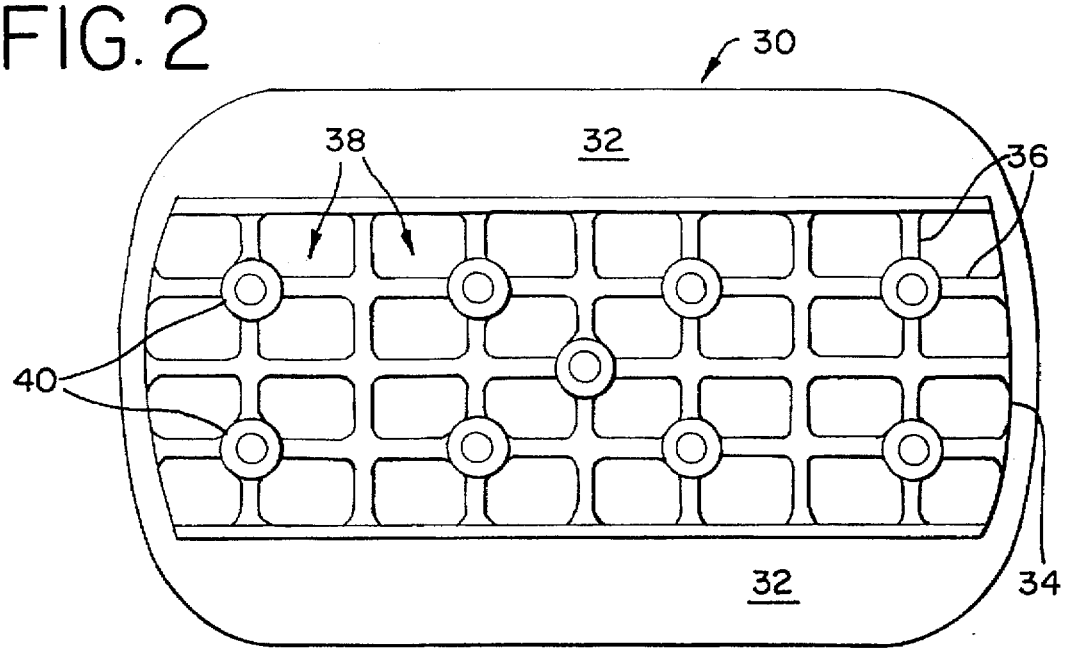
FIG. 2 is a bottom plan view of a shell for a roadway marker constructed in accordance with the principles of the invention.
Figure 3:
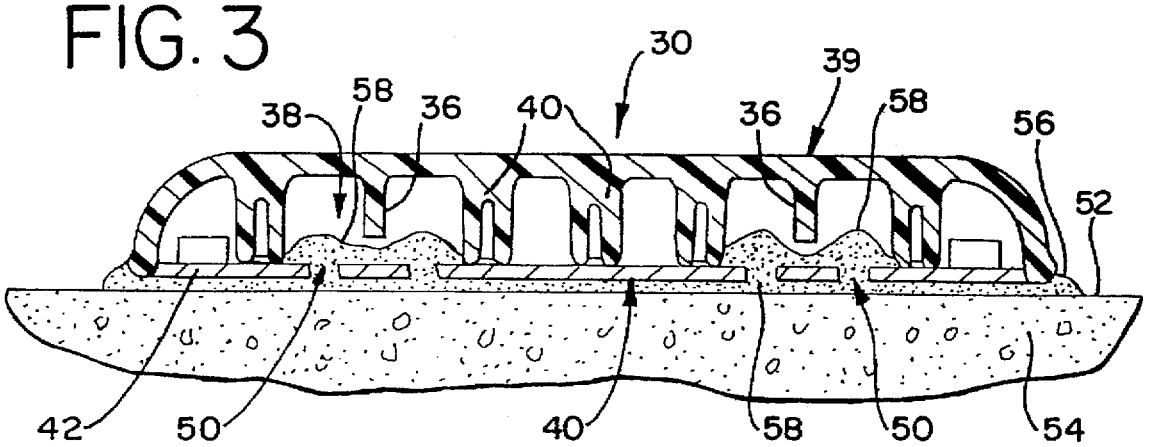
FIG. 3 is a side cross-sectional view of a roadway marker shell and base plate constructed in accordance with the principles of the invention and illustrated as installed with adhesive on a roadway surface.

Turning now to FIGS. 2 and 3, a marker shell constructed in accordance with the present invention is designated generally by the reference numeral 30. The shell 30 comprises a bottom surface 32 having a large central opening 34 in which a series of integrally-formed vertical ribs 36 are arranged to define individual cells or chambers 38. In a manner well-known in the art, upper surface 39 of the shell 30 may be provided with one or more reflective elements (not shown). At preselected spaced intervals within the opening 34 are a plurality of bosses 40. Adhered to the bosses 40, as by ultrasonic welding for example, and covering the entire opening 34, is a base plate 42.

Figure 4:
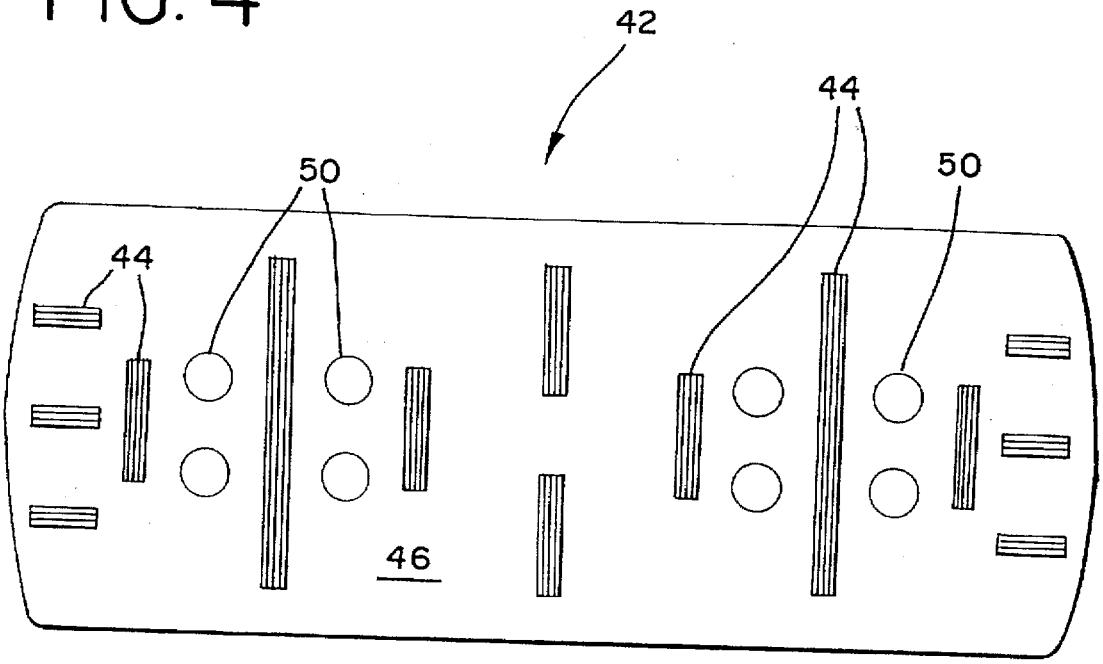
FIG. 4 is a top plan view of the base plate shown in FIG. 3.
Figure 5:
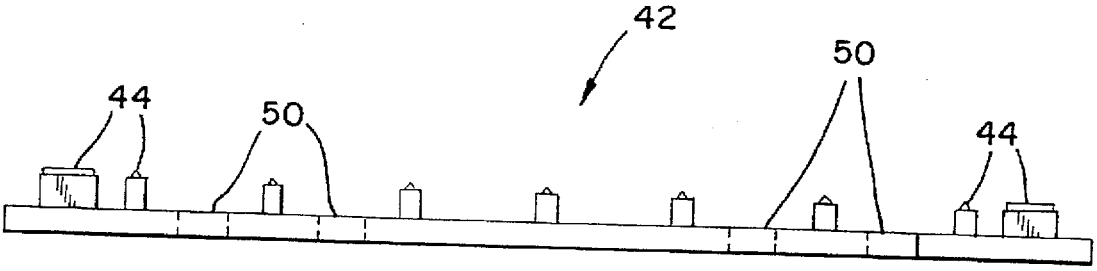
FIG. 5 is a side cross-sectional view of the base plate of FIG. 4.

As best seen in FIGS. 4 and 5, the base plate 42 is a generally thin, elongate member which preferably is formed with suitable strengthening ribs 44. The strengthening ribs 44 are so located on the plate 42 as to not interfere with the bosses 40 of the shell 30. Further, the ribs 44 are dimensioned and arranged to each abut a downwardly extending rib 36 of the shell 30. Thus, the ribs 36 and 44 cooperate to firmly support the surface 39 of the shell 30 against tire loads. The ribs 36 and 44 are also preferably ultrasonically welded together. Thereby, the plate 42 fits within opening 34 to form a continuous surface 46 with bottom surface 32 of the shell 30. In accordance with the invention, the plate 42 is provided with a plurality of apertures 50, the purpose of which will be described hereinafter.

Referring again to FIG. 3, the shell 30 with connected base plate 42 is illustrated as installed on a surface 52 of a roadway pavement 54 by suitable adhesive 56. The adhesive 56 is preferably of a type such as bitumen which has a rapid cure time so that installation of the marker can be done with minimal automobile traffic interruption. As FIG. 3 illustrates, the condition of the adhesive 56 is such that a uniform layer 58 of adhesive 56 is formed between the roadway surface 52 and the entire bottom surfaces 46 and 32 of the plate 42 and shell 30, respectively. Further, adhesive 56 flows through the apertures 50 of the base plate 42 and into internal chambers 38 of the shell 30. Before the adhesive 56 sets or cures, it assumes a mushroomed configuration 58 within the chambers 38.

It can now be appreciated that an assembly of a shell 30 and base plate 42 according to the invention offers considerable resistance to forces such as tire impact forces tending to dislodge the assembly from the pavement surface. The mushroomed configuration 58 of the adhesive 56 at apertures 50 of the plate 42 provide substantial resistance to forces having a component directed normal to the surface of the pavement. Moreover, the relatively large surface area of the plate 42 with coextensive adhesive 56 offers considerable resistance to shear forces as are common in installed conditions of markers. It can further be appreciated that the plate 42, and not the adhesive 56, bears the effect of increased air pressure within the chambers 38. Therefore, unlike prior markers having chambers sealed with adhesive, the present marker assembly is also highly resistant to dislodgement under the effect of internal pressure forces which may be occasioned by elevated ambient temperature conditions.

While the present invention has been described in connection with a preferred embodiment thereof, it will be apparent to those skilled in the art that many changes and modifications may be made without departing from the true spirit and scope of the present invention. Accordingly, it is intended by the appended claims to cover all such changes and modifications as come within the true spirit and scope of the present invention.

What is claimed is:

1. A roadway marker comprising:

a shell having an upper exposed surface, a lower surface portion and a central opening defined in said lower surface portion;

a plurality of ribs formed internal to said shell, said ribs being arranged to form discrete chambers within said shell;

a base plate connected to said shell and covering said ribs and said opening, said plate having a generally planar lower surface and a generally planar upper surface internal to said shell; and a plurality of apertures formed through said plate, each aperture communicating with a chamber defined by said ribs;

wherein adhesive flows through said apertures and mushrooms above said upper surface of said plate within said chambers when said marker is adhered to a roadway surface.

2. The marker of claim 1 wherein said chambers define a honeycomb configuration.

3. The marker of claim 1 wherein said shell further includes bosses projecting downwardly of said shell for attachment of said base plate.

4. The marker of claim 3 wherein said base plate is provided with upwardly projecting strengthening ribs and said base plate ribs are configured to project into said shell in spaced relation to said bosses.

5. The marker of claim 2 wherein said lower surface of said plate and said lower surface portion of said shell are disposed in a common plane.

6. The marker of claim 1 wherein said ribs are formed integrally with said shell.

7. The marker of claim 1 wherein said base plate is provided with strengthening ribs extending vertically upward from said upper plate surface.

8. The marker of claim 7 wherein selective ribs of said shell and selective ribs of said base plate are mutually aligned and in abutment with one another to support said shell on said base plate.

* * * * *